United States Patent [19]

Saeki et al.

[11] Patent Number: 4,929,530

[45] Date of Patent: May 29, 1990

[54] LIGHT IMAGE FORMING MATERIAL AND IMAGE-RECORDING METHOD USING SUCH

[75] Inventors: Keiso Saeki; Tosiaki Endo, both of Shizuoka, Japan

[73] Assignee: Fuji Photo Film Co., Ltd., Kanagawa, Japan

[21] Appl. No.: 324,504

[22] Filed: Mar. 16, 1989

[30] Foreign Application Priority Data

Mar. 16, 1988 [JP] Japan ..... 63-62146
Apr. 1, 1988 [JP] Japan ..... 63-80281

[51] Int. Cl.[5] ..... G03C 1/72

[52] U.S. Cl. ..... 430/138; 430/495; 430/541

[58] Field of Search ..... 430/138, 211, 224, 264, 430/559, 495, 541; 503/224

[56] References Cited

U.S. PATENT DOCUMENTS

| | | | |
|---|---|---|---|
| 4,430,415 | 2/1984 | Aono et al. | 430/138 |
| 4,500,624 | 2/1985 | Aono et al. | 430/138 |
| 4,769,305 | 9/1988 | Sano et al. | 430/138 |
| 4,775,656 | 10/1988 | Harada et al. | 430/138 |
| 4,800,148 | 1/1989 | Harada et al. | 430/138 |

*Primary Examiner*—Roland E. Martin
*Assistant Examiner*—Hoa Van Le
*Attorney, Agent, or Firm*—Sughrue, Mion, Zinn, Macpeak & Seas

[57] ABSTRACT

An optical image forming material comprising a support (A) at least one member selected from the group consisting of oxidative-developable leuco dyes, (B) at least one member selected from the group consisting of photo-oxidizing agents, (C) at least one reducing agent and (D) at least one organic sulfonamide compound and/or at least one member selected from the group consisting of hydroxy compounds represented by the following formula (I) or (II)

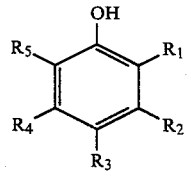

(I)

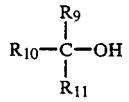

(II)

wherein $R_1$ to $R_{11}$ are as described herein, the leuco dye (A) and the photo-oxidizing agent (B) being present in microcapsules, and the reducing agent (C) and the organic sulfonamide compound and/or the hydroxy compound (D) being present outside of the microcapsules.

18 Claims, No Drawings

LIGHT IMAGE FORMING MATERIAL AND IMAGE-RECORDING METHOD USING SUCH

FIELD OF THE INVENTION

This invention relates to a light image forming material and an image recording method using it. More particularly this invention relates to a light image forming material and an image recording method using it useful in the fields of proofing papers, printing-out papers, overlay films, etc.

BACKGROUND OF THE INVENTION

Light image forming materials of this kind have been conventionally used in many photographic applications as a so-called free radical photograph in which a sensitive area is visualized by exposure of an image.

Particularly effective techniques for free radical photography are methods where various leuco dyes are developed to the corresponding colored dyes by oxidation with photo-oxidizing agents as described, for example, in Photo. Sci. Eng., 5, 98–103 (1961), JP-B No. 43-29407 (the term "JP-B" as used herein means an "examined Japanese patent publication"), JP-A No. 55-55335 (corresponding to U.S. Pat. No. 4,271,251), JP-A No. 57-60329 (corresponding to U.S. Pat. No. 4,298,678) and JP-A No. 62-66254 (corresponding to U.S. Pat. No. 4,622,286) (the term "JP-A" as used herein means an "unexamined published Japanese patent application").

However, these light image forming materials are sensitive to light so that when they are exposed to general indoor light, sunlight or white light, colors are formed even after a dye image is formed by exposure. Hence, there is a difficulty in handling such light image forming materials.

In order to retain the image once the image has formed, color development in areas not irradiated during exposure must be prevented from occurring. For example, it is known to preserve the original image by applying a solution of a reducing agent such as a free radical-capturing, substance (e.g., hydroquinone) to a material having an image formed thereon by means of spraying or impregnation. However, this method requires complicated working and operating conditions since it is a wet process, though this method is advantageous in the preservation and fixing of the original image. There are commercially available materials such as Dylux® (tradename for a product of du Pont) having the excellent property that an image is formed by UV light and fixed by the activation of a photo-reducing substance with visible light, that is, they can be processed simply by light. However, when a device is exclusively used during the processing period by using light twice in this process, the replacement of spectral filters, etc. must be conducted so that there is a disadvantage that processing speed is unsatisfactory. Further, the above-mentioned JP-B No. 43-29407 discloses that thermal fixing is carried out after the exposure of an image either by incorporating a reducing thermal fixing agent together with a leuco dye and a photo-oxidizing agent in a binder solution, or by overcoating a photosensitive layer with the thermal fixing agent. However, this method has the disadvantage that sensitivity is deteriorated with the passage of time, since the light sensitive parts (the leuco dye and the photo-oxidizing agent) are present with the fixing agent in close proximity to each other.

These light image forming materials comprising the leuco dyes and the photo-oxidizing agents are uniformly dissolved in organic solvents and applied (e.g., by coating, immersion, casting, etc.) to supports such as paper and synthetic resin films. The solvents are evaporated by drying. Accordingly, explosion-proofing precautions for the manufacturing plants thereof due to the use of the volatile organic solvents are required. Thus, these processes are disadvantageous in safety and cost.

SUMMARY OF THE INVENTION

An object of the present invention is to provide a light image forming material having excellent image reproducibility, storage stability before recording and image stability (fixing property).

Another object of the present invention is to and completely dry image forming and fixing processes.

Still another object of the present invention is to provide an optical image forming material which will dispense with or reduce the labor of handling it in organic solvent systems which cause problems in the manufacturing process thereof.

The above objects of the present invention have been achieved by providing a light image forming material comprising a support, (A) at least one member selected from the group consisting of oxidative-developable leuco dyes, (B) at least one member selected from the group consisting of photo-oxidizing agents, (C) at least one reducing agent and (D) at least one organic sulfonamide compound and/or at least one hydroxyl compound, the leuco dye (A) and the photo-oxidizing agent (B) being present in microcapsules (hereinafter "inner components") and the reducing agent (C) and the organic sulfonamide compound and/or the hydroxy compound (D) being present outside of the microcapsules (hereinafter "outer components").

The above objects of the present invention have also been achieved by providing an image recording method comprising irradiating the light image forming material with light to form an image and then conducting fixing by causing the photo-oxidizing agent and the reducing agent to contact with each other.

DETAILED DESCRIPTION OF THE INVENTION

A feature of the light image forming material of the present invention is in that microcapsules are used and the organic sulfonamide compound and/or the hydroxy compound are/is present outside of the microcapsules.

Namely, the basic functions of the microcapsules are as follows:

(1) The components can be microscopically isolated from each other inside and outside the microcapsule.

(2) When the components are enclosed in the microcapsules, the influence of external environment (particularly, moisture, oxygen, storage temperature, etc.) on the components can be markedly reduced and the materials can be stored in a stable manner.

(3) If desired, the materials in the microcapsules can be removed by means of an external action (e.g., heat, pressure, etc.) or the additives present outside the microcapsule can be introduced into the microcapsule for reaction of the inner and outer components with each other.

(4) The dispersion of the microcapsule as a whole can be handled as an aqueous system, even when the core material of the microcapsules is an oily organic solvent.

In the present invention, the above functions (1) and (2) are utilized as a means for improving stability of the system, the above functions (1) and (3) are utilized as a means for a simple recording method where fixing is achieved by heating after exposure, and the above function (4) is utilized as a means for improving workability during manufacture.

The presence of the organic sulfonamide compound and/or hydroxy compound outside the microcapsules is utilized as an excellent low-temperature fixing technique which does not have an adverse effect on the storage stability before recording.

In the present invention, preferred microcapsules are those which prevent materials present inside and outside of the capsules from contacting each other by the material-isolating function of the microcapsule wall at room temperature, but the permeability of the wall material is increased only by heating at a certain temperature or higher. This phenomenon allows the penetration initiating temperature to be arbitrarily controlled by properly choosing the wall material of the microcapsules, the core material of the capsules and additives present. In this case, the penetration initiating temperature corresponds to the glass transition temperature of the wall of the capsule as described, for example, in JP A No. 59-91438 (corresponding to U.S. Pat. No. 4,529,681), JP-A No. 59-190886 (corresponding to U.S. Pat. No. 4,650,740) and JP-A No. 60-242094 .

In order to control the glass transition temperature specific to the wall of the capsules, it is necessary to change the type of the wall forming material of the capsules. Examples of the wall forming materials which can be used in the present invention include materials such as, polyurethanes, polyureas, polyesters, polycarbonates, urea-formaldehyde resins, melamine-formaldehyde resins, polystyrene, styrene-methacrylate copolymers, gelatin, polyvinyl pyrrolidone and polyvinyl alcohol. These high molecular weight materials may be used alone or as a combination of two or more thereof.

Polyurethanes, polyureas, polyamides, polyesters and polycarbonates are preferred of these high molecular weight materials. Polyurethanes and polyureas are particularly preferred.

It is preferred that the microcapsules of the present invention are prepared in such a manner that a core material comprising reactive substances such as a leuco dye and a photo-oxidizing agent is emulsified and a wall composed of a high molecular weight material is formed around the resulting oil droplet to thereby microencapsulate the core material. In this case, a reactant forming the high molecular weight material is added inside the oil droplet and/or outside the oil droplet. Preferred methods for preparing microcapsules and microcapsules which can be used in the present invention, are described in more detail in U.S. Pat. Nos. 3,726,804 and 3,796,696.

For example, when polyurethane urea is used as the wall material of the capsules, a polyhydricisocyanate is added to an inner phase and a second substance (e.g., a polyol) capable of reacting with the polyhydricisocyanate to form the wall is added to an outer aqueous phase or an oily phase as inner phase. This mixture is dispersed in water and then the temperature of this dispersion is elevated, whereby a high molecular weight material-forming reaction takes place at the interface of the oil droplets to form the wall of the capsule is formed. When the second substance is a polyamine or a second substance is not used, a polyurea is formed as the wall forming material.

Examples of polyhydricisocyanates and polyols and polyamines to be reacted with the polyhydricisocyanates are disclosed in U.S. Pat. Nos. 3,281,383, 3,773,695, 3,793,268, JP-B No. 48-40347 (corresponding to U.S. Pat. No. 3,723,363), and JP-A No. 48-84086 (corresponding to U.S. Pat. No. 3,838,108).

Specific examples of polyhydricisocyanates which can be used in the present invention include diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-dimethoxy-4,4'-biphenyl diisocyanate, 3,3'-dimethyldiphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate and cyclohexylene-1,4-diisocyanate; triisocyanates such as 4,4',4''-triphenylmethane triisocyanate and toluene-2,4,6-triisocyanate; tetraisocyanates such as 4,4'-dimethyldiphenylmethane-2,2',5,5'-tetraisocyanate; and isocyanate prepolymers such as adducts of hexamethylene diisocyanate with trimethylolpropane, adducts of 2,4-tolylene diisocyanate with trimethylolpropane, adducts of xylylene diisocyanate with trimethylolpropane and adducts of tolylene diisocyanate with hexanetriol.

Aliphatic and aromatic polyhydric alcohols, hydroxypolyesters and hydroxypolyalkylene ethers can be used as the polyol.

Polyols described in JP-A No. 60-49991 can be used. Examples of polyols described therein are ethylene glycol, 1,3-propanediol, 1,4-butanediol, 1,5-pentanediol, 1,6hexanediol, 1,7-heptanediol, 1,8-octanediol, propylene glycol, 2,3-dihydroxybutane, 1,2-dihydroxybutane, 1,3dihydroxybutane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethylene glycol, 1,2,6-trihydroxyhexane, 2-phenylpropylene glycol, 1,1,1-trimethylolpropane, hexanetriol, pentaerythritol, adducts of ethylene oxide to pentaerythritol, adducts of ethylene oxide to glycerin, condensation products of aromatic polyhydric alcohols such as glycerin, 1,4-bis(2-hydroxyethoxy)benzene and resorcinol dihydroxyethyl ether with alkylene oxides, p-xylylene glycol, mxylylene glycol, $\alpha$, $\alpha'$-dihydroxy-p-diisopropylbenzene, 4,4'-dihydroxy-diphenylmethane, 2-(p,p'-dihydroxydiphenylmethyl)benzyl alcohol, adducts of ethylene oxide with bisphenol A and adducts of propylene oxide with bisphenol A. It is preferred that the polyol is used in an amount of 0.02 to 2 mol as hydroxy group per mol of isocyanate group.

Examples of polyamines include ethylenediamine, trimethylenediamine, tetramethylenediamine, pentamethylphenylenediamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentamine and amine addition products of epoxy compounds. Polyureas can also be formed by reacting a polyisocianate with water.

Organic solvents which can be used in forming oil droplets can be chosen from high-boiling oils. Examples of suitable organic solvents include phosphoric acid esters, phthalic acid esters, acrylic acid esters, methacrylic acid esters, other carboxylic acid esters, fatty acid amides, alkylated biphenyls, alkylated terphenyls, chlorinated paraffin, alkylated naphthalenes and diarylethanes. More specifically, those solvents described in JP-A-60-242094 and Japanese Patent Application No. 62 -75409 can be used.

In the present invention, low-boiling co-solvents, as a dissolution aid, may be added to the above-described organic solvents, if desired. Particularly preferred examples of co-solvents include ethyl acetate, isopropyl acetate, butyl acetate and methylene chloride.

Water-soluble high molecular weight materials as a protective colloid present in the water phase to be mixed with the oil phase, can be chosen from conventional anionic high molecular weight materials, nonionic high molecular weight materials and amphoteric high molecular weight materials. Of these polyvinyl alcohol, gelatin and cellulose derivatives are preferred.

Suitable surfactants which can be present in the water phase, include anionic or nonionic surfactants which do not cause precipitation or aggregation by reacting with the aforementioned protective colloid. Preferred examples of such surfactants include sodium alkylbenzenesulfonates (e.g., sodium lauryl sulfonate), sodium dioctylsulfosuccinate and polyalkylene glycols (e.g., polyoxyethylene nonylphenyl ether).

The size of the microcapsule of the present invention is preferably not larger than 20 $\beta$m, particularly not larger than 4 $\beta$m in terms of volume mean particle size as measured by the measuring method described, e.g., in JP-A No. 60-214990 (corresponding to U.S. Pat. No. 4,598,035) from the standpoints of improving the resolving power of the images formed, the storage stability of the images and the handling property of the microcapsules. When the size of the microcapsule is too small, there is the possibility that the microcapsule is lost in the voids in a substrate or in the fiber of the substrate. The size of the microcapsule varies depending on the properties of the substrate or the support, but should be preferably 0.1$\mu$ or larger.

The leuco dye which constitutes one component of the light image forming material of the present invention are described below.

Leuco dyes which can be used in the present invention include reduction type dyes which have one or two hydrogen atoms and are capable of developing color by the elimination of a hydrogen atom or by the addition of an additional electron in some cases to form a dye. These leuco dyes are substantially colorless or slightly colored so that a pattern can be formed when a color is developed by oxidation. This oxidation can be achieved by the presence of at least one photo-oxidizing agent as used in the present invention. The photo-oxidizing agent is activated by light irradiation and reacts with the leuco dye, whereby a colored image is formed contrasting with the background of the unirradiated, i.e., unchanged material, areas.

Examples of suitable leuco dyes which develop a color by the above-mentioned oxidation mechanism include those disclosed, for example, in U.S. Pat. No. 3,445,234. Suitable leuco dyes described therein are the following compounds.

(a) Aminotriarylmethane
(b) Aminoxanthene
(c) Aminothioxanthene
(d) Amino-9,10-dihydroacridine
(e) Aminophenoxazine
(f) Aminophenothiazine
(g) Aminodihydrophenazine
(h) Aminodiphenylmethane
(i) Leuco indamine
(j) Aminohydrocinnamic acid (cyanoethane, leucomethine)
(k) Hydrazine
(l) Leuco indigoid dye
(m) Amino-2,3-dihydroanthraquinone
(n) Tetrahalo-p,p'-biphenol
(o) 2-(p-Hydroxyphenyl)-4,5-diphenylimidazole
(p) Phenethylaniline Of these leuco dyes, compounds (a) to (i) develop a color by the loss of one hydrogen atom to form a dye, while leuco dyes (j) to (p) form parent dyes by loss of two hydrogen atoms. Among them, aminotriarylmethanes are preferred. Generally, preferred aminotriarylmethanes and acid addition salts thereof are those wherein at least two of aryl groups are phenyl groups having (a) a $R_1R_2N$-substituent group bonded to the benzene ring at a para-position with respect to the carbon atom of the methane moiety wherein $R_1$ and $R_2$ are each a member selected from the group consisting of a hydrogen atom, an alkyl group having from 1 to 10 carbon atoms, a 2-hydroxyethyl group, a 2-cyanoethyl group and a benzyl group, and (b) a substituent group bonded to the benzene ring at the orthoposition with respect to the carbon atom of the methane moiety, this substituent group (b) being a member selected from the group consisting of a lower alkyl group having from 1 to 4 carbon atoms, a lower alkoxy group having from 1 to 4 carbon atoms, fluorine, chlorine, hydrogen and bromine; and aminotriarylmethanes and acid addition salts thereof wherein the third aryl group may be the same as or different from the first two aryl groups and when the third aryl group is different from the first two aryl groups, the third aryl group is selected from the group consisting of (a) a phenyl group which may be optionally substituted with a lower alkyl group (preferably having from 1 to 4 carbon atoms), a lower alkoxy group (preferebly having from 1 to 4 carbon atoms), chlorine, a diphenylamino group, a cyano group, a nitro group, a hydroxyl group, fluorine, bromine, an alkylthio group, an arylthio group, a thio ester group, an alkylsulfone group, an arylsulfone group, a sulfo group, a sulfonamido group, an alkylamido group, an arylamido group, etc., (b) a naphthyl group which may be optionally substituted with an amino group, a dilower alkylamino group and an alkylamino group, (c) a pyridyl group which may be optionally substituted with an alkyl group, (d) a quinolyl group and (e) an indolinylidene group which may be optionally substituted with an alkyl group. The aminotriarylmethanes where $R_1$ and $R_2$ are each hydrogen or an alkyl group having from 1 to 4 carbon atoms, are preferred. Most preferred are the aminotriarylmethanes where all of the three aryl groups are the same.

There is a possibility that the triarylmethanes having the above-mentioned structure and other leuco dyes undergo a color-forming dark reaction which causes fogging or coloration by the reaction of photo-oxidizing agents with leuco dye during storage before light exposure, when they are applied as a component of the conventional light image forming material such as photographic films, paper or other photographic systems.

However, the leuco dyes can be used in the microcapsules according to the present invention, because the color-forming dark reaction can be prevented from taking place by the use of microcapsules having an effect of storing such compositions containing the leuco dyes in the absence of air.

Photo-oxidizing agents which are preferably used in the present invention are inactive until they are exposed to actinic rays such as visible light, ultraviolet light, infrared rays, X-rays, etc. The photo-oxidizing agents have different peak sensitivity over the entire spectral range. Therefore, the specific photo-oxidizing agent used depends upon the properties of the actinic rays to be used. The photo-oxidizing agents produce oxidizing agents which oxidize color formers to colored forms thereof, when exposed to radiation.

Typical examples of photo-oxidizing agents include, but are not limited to, halogenated hydrocarbons such as carbon tetrabromide, N-bromosuccinimide and tribromomethylphenylsulfone disclosed in U.S. Pat. Nos. 3,042,515 and 3,502,476; azide polymers as described in Shunki Kenkyu Happyokai Koen Yoshi, ed. Nippon Shashin Gakkai p. 55, (1968); azide compounds such as 2-azidobenzoxazole, benzoyl azide and 2-azidobenzimidazole disclosed in U.S. Pat. No. 3,282,692; compounds such as 3'-ethyl-1-methoxy-2-pyridothiacyanin perchlorate and 1-methoxy-2-methylpyridinium p-toluenesulfonate disclosed in U.S. Pat. No. 3,615,568 and compounds such as lophine dimer compounds (e.g., 2,4,5-triarylimidazole dimer) disclosed in JP-B No. 62-39728, benzophenone, p-aminophenyl ketones, polynuclear quinones and thioxanthenone. These photo-oxidizing agents may be used either alone or as a mixture of two or more of them.

Good results can be obtained by mixing the leuco dye with the photo-oxidizing agent in a molar ratio of from about 10:1 to about 1:10 in the preparation of the optical image forming material of the present invention. A more preferred ratio is from 2:1 to 1:2.

A stable image can be obtained, for example, by conducting a heat treatment after the formation of the image by the exposure of the light image forming material of the present invention. Namely, the fixing mechanism of the light image forming material of the present invention is such that, for example, even when the photo-oxidizing agent is activated after the fixing, the photo-oxidizing agent with the reducing agent are bought into contact through the wall of the capsule by heating, the oxidizing agent is deactivated by the action of the reducing agent.

The reducing agent functions as a free radical-capturing substance which traps the free radicals of the activated photo-oxidizing agent.

Any conventional free radical capturing substances can be used. Examples of suitable free radical capturing substances include organic reducing agents having a hydroxyl group on a benzene ring and further a hydroxyl group or an amino group at another position than the position of the benzene ring (e.g., hydroquinone, catechol, resorcinol, hydroxyhydroquinone, pyrrologlycinol and aminophenols such as o-aminophenol and paminophenol) disclosed in U.S. Pat. No. 3,042,515; and cyclic phenylhydrazide compounds such as 1-phenylpyrazolidine-3-one [phenidone A represented by the following Formula (a)], 1-phenyl-4-methylpyrazolidine-3-one [phenidone B represented by the following Formula (b)], 1-phenyl-4,4 dimethylpyrazolidine-3-one [dimezone represented by the following Formula (c)], 3-methyl-1-(p-sulfo-phenyl)-2-pyrazoline-5-one and 3-methyl-1-phenyl-2-pyrazoline-5-one.

(a)

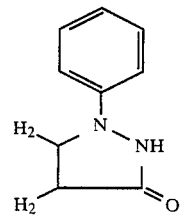

(b)

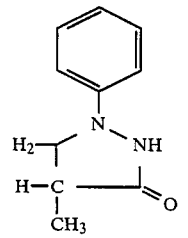

(c)

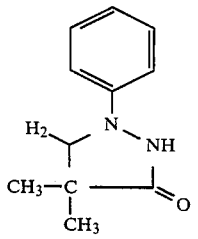

The phenyl group of the above-described cyclic phenylhydrazides may have one or more substituent groups. Examples of suitable substituent groups include o-, m- and p-methyl, p-trifluoromethyl, m- and p-chloro, m- and pbromo, p-fluoro, o-, m- and p-methoxy, p-ethoxy, pbenzyloxy, p-butoxy, p-phenoxy, 2,4,6-trimethyl and 3,4dimethyl. The position 4 of the heterocyclic ring of the cyclic phenylhydrazides may be optionally substituted with bis-hydroxymethyl, hydroxymethyl and methyl, hydroxymethyl, dimethyl, dibutyl, ethyl or benzyl. The position 5 of the heterocyclic ring of the cyclic phenylhydrazides may be optionally substituted with dimethyl, methyl and phenyl.

Further, compounds such as guanidine derivatives, alkylenediamine derivatives and hydroxyamine derivatives can be used. Examples of guanidine derivatives include phenylguanidine, 1,3-diphenylguanidine, 1,2,3-triphenylguanidine, 1,2-dicyclohexylguanidine, 1,2,3-tricyclohexylguanidine, 1,3-di-o-tolylguanidine, o-tolyldiphenylguanidine, m-tolyldiphenylguanidine, p-tolyldiphenylguanidine, N,N'-dicyclohexyl-4-morpholinocarboxyamidine, 1,3-ditolyl-3-phenylguanidine, 1,2-dicyclohexylphenylguanidine, 1-o-tolylbiguanide and N-benzylidene-guanidinoamine.

Examples of alkylenediamine derivatives include ethylenediamine, propylenediamine, tetramethylenediamine, hexamethylenediamine, octamethylenediamine, 1,1,2-diaminododecane and tetrabenzylethylenediamine.

Examples of hydroxyamine derivatives include diethanolamine, triethanolamine and 3-$\beta$-naphthyloxy-1-N,N-dimethylamino-2-propanol.

The reducing agents functioning as free radical-capturing (trapping) substances may be used either alone or as a combination of two or more of them. Any reducing materials capable of reacting with the oxidizing agents can be used without being limited to the above-described compounds.

In the light image forming material of the present invention, the leuco dye is enclosed in the microcapsule together with the photo-oxidizing agent, while the reducing agent which is not enclosed in the microcapsule, it is preferred that the reducing agent be dispersed in the form of a solid by means of a sand mill, etc. Alternatively, the reducing agent is dissolved in oil and then dispersed by emulsification.

In dispersing the reducing agent as a solid, the reducing agent is dispersed in a solution of 10 to 30% by weight in a water-soluble high molecular weight material to prepare a dispersion having a dispersed particle size of not larger than 10 μm. The water-soluble high molecular weight materials for use in preparing the microcapsules are preferred as the water-soluble high molecular weight materials for use in dispersing the reducing agent. The method and the materials described in Japanese Patent Application No. 62-75409 can be employed for dispersing the reducing agent by emulsification.

The reducing agent is used in an amount of preferably 1 to 100 times by mol that of the photo-oxidizing agent. To obtain the desired results by using the reducing agent in an amount of as small as possible, the reducing agent is used in an amount of more preferably 1 to 10 times by mol that of the photo-oxidizing agent.

The fixing of the image in the present invention can be performed by bringing the photo-oxidizing agent and the reducing agent into contact with each other through the wall of the microcapsules by means of heating as described above.

It is believed that the organic sulfonamide compound and/or the hydroxy compound used in the present invention which are/is allowed to be present with the reducing agent outside of the microcapsule, causes lower in the melting point of the reducing agent and improve the permeability of the wall of the microcapsule by heat and, as a result, low-temperature fixing is possible.

Among the organic sulfonamide compounds and the hydroxy compounds which are used in the present invention, compounds having a melting point of 50° to 200° C. are preferred and compounds having a melting point of 70° to 150° C. are particularly preferred.

Typical examples of the organic sulfonamide compounds which can be used include p-toluene sulfonamide, o-toluenesulfonamide, benzenesulfonamide, p-toluenesulfonanilide, N-(p-methoxyphenyl)-p-toluensulfonamide, N-(o-methoxyphenyl)-p-toluenesulfonamide, N-(p-chlorophenyl)-p-toluenesulfonamide, N-(o-chlorophenyl)-p-toluenesulfonamide, N-benzyl-p-toluenesulfonamide, N-(2-phenethyl)-p-toluenesulfonamide, N-(2-hydroxyethyl)-p-toluenesulfonamide, N-(3-methoxypropyl)-p-toluenesulfonamide, methanesulfonanilide, N-(p-tolyl)sulfonamide, N-(o-tolyl)sulfonamide, N-(p-methoxyphenyl)-sulfonamide, N-(o-methoxy)sulfonamide, N-(p-chlorophenyl)sulfonamide, N-(o-chlorophenyl)sulfonamide, N-(2,4-xylyl)sulfonamide, N-(p-ethoxyphenoxyethyl)methanesulfonamide, 1,3-bis(methanesulfonylamino)benzene, 1,3-bis(p-toluenesulfonylamino)propane and p-ethylbenzenesulfonamide. However, sulfonamide compounds which can be used are not limited to the above-described compounds.

The organic sulfonamide compound of the present invention is preferably used in an amount of 0.01 to 10 parts by weight, more preferably 0.1 to 5 parts by weight, per one part by weight of the reducing agent.

The hydroxy compounds which can be used in the present invention are represented by the following Formula (I) or (II).

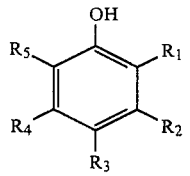

(I)

wherein $R_1$ to $R_5$, which may be the same or different, each represents a hydrogen atom, an alkyl group, a cycloalkyl group, an aryl group, an alkoxy group, a group of the formula $COOR_6$ or a group having the following formula:

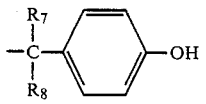

wherein each of the alkyl group, the aryl group and the alkoxy group may have one or more substituent groups. Examples of suitable substituent groups therefor include a halogen atom, a hydroxyl group, an alkoxy group, an aryl group, an aryloxy group, etc. $R_6$ represents an alkyl group, and $R_7$ and $R_8$, which may be the same or different, each represents a hydrogen atom or an alkyl group:

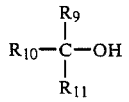

(II)

wherein $R_9$ to $R_{11}$, which may be the same or different, each represents a hydrogen atom, an alkyl group, an aryl group, a hydroxyalkyl group or an aryloxyalkyl group. Each of these groups may have one or more substituent groups. Examples of suitable substituent groups therefor include a halogen atom, a hydroxyl group, an alkoxy group, an aryl group, an aryloxy group, a hydroxyalkyl group, a hydroxyalkoxy group, etc.

Specific examples of the compounds represented by Formula (I) include p-t-butylphenol, p-t-octylphenol, p-α-cumylphenol, p-t-pentylphenol, m-xylenol, 2,5-dimethylphenol, 2,4,5-trimethylphenol, 3-methyl-4-isopropylphenol, p-benzylphenol, o-cyclohexylphenol, p-(diphenylmethyl)phenol, p- (α, α-diphenylethyl)-phenol, o-phenylphenol, ethyl p-hydroxybenzoate, propyl p-hydroxybenzoate, butyl p-hydroxybenzoate, benzyl p-hydroxybenzoate, p-methoxyphenol, p-butoxyphenol, p-heptyloxyphenol, p-benzyloxyphenol, dimethyl 3-hydroxyphthalate, 1,1-bis(4-hydroxyphenyl)-dodecane, 1,1-bis(4-hydroxyphenyl)-2-ethyl-hexane, 1,1-bis(4-hydroxyphenyl)-2-methyl-pentane, 2,2-bis(4-hydroxyphenyl)heptane, 2-t-butyl-4-methoxyphenol, 2,6-dimethoxyphenol, resorcinol mono-(2-hydroxyethyl)ether and 2-hydroxymethyl-p-cresol.

Specific examples of compounds represented by Formula [II]include 2,5-dimethyl-2,5-hexanediol, resorcinol bis(2-hydroxyethyl)ether, 1,4-bis(hydroxy ethoxy)- benzene, p-xylylenediol, 1-phenyl-1,2-ethanediol, diphenylmethanol, 1,1-diphenylethanol, 2-methyl-2-phenyl-1,3-propanediol, salicyl alcohol, and 3-(o-methoxyphenoxy)-1,2-propanediol.

The hydroxy compound used in the present invention is preferably employed in an amount of 0.01 to 10 parts by weight, more preferably 0.1 to 5 parts by weight per one part by weight of the reducing agent.

The above described organic sulfonamide compound and the hydroxy compound may be used either alone or as a mixture thereof, respectively, and the organic sulfonamide compound and the hydroxy compound can be used in combination therewith.

In the case of using the organic sulfonamide compound and the hydroxy compound in combination, these compounds are preferably used employed in a total amount of from 0.01 to 10 parts by weight, more preferably 0.1 to 5 parts by weight per one part by weight of the reducing agent, and the ratio of the organic sulfonamide compound and the hydroxy compound is preferably from 1/100 to 100/1, more preferably from 1/10 to 10/1.

Conventional sensitizing agents may be used in the present invention as an additional component to the photo oxidizing agent. For example, compounds described in Katsumi Tokumaru and Shin Okawara, *Sensitizing Agent,* pages 64 to 75, published by Kodansha (1987) can be used. Specific examples of suitable sensitizing agents include carbonyl compounds such as aromatic ketones, acetophenones, diketones and acyl oxime esters; sulfur compounds such as aromatic thiols, mono- and disulfides, thioureas and dithiocarbamates; organic peroxides such as benzoyl peroxide; azo compounds such as azobisisobutyronitrile; and halides such as N-bromosuccinimide. Suitable sensitizing dyes in the region of visible light which can be used are dyes having chromophoric groups such as amidinium ion type, carboxyl ion type and amphoteric amide type dyes as described in the *Sensitizinq Aqent,* supra, pages 106 to 123. Typical examples of sensitizing dyes include cyanine dyes, phthalein dyes and oxonol dyes.

Conventional stabilizers such as antioxidants may be present in the microcapsules of the present invention. The stabilizer is a substance having a function similar to that of the reducing agent so that the amount of the stabilizer to be added can be as small as possible, though the purpose of adding the stabilizer is different from the purpose of adding the reducing agent. Examples of suitable stabilizers include compounds described in U.S. Pat. No. 4,066,459 and 2,4-dihydroxyaldoxime described in JP-A No. 55-55335 (corresponding to U.S. Pat. No. 4,271,251) in addition to the above-described free radical-capturing substances. The amounts of these stabilizers to be used are in the range of preferably about 0.01 to about 25 mol %, most preferably 0.1 to 10 mol %, based on the amount of the photo-oxidizing agent.

The light image forming material of the present invention can be prepared by coating or impregnating a support with a dispersion of the reducing agent, the organic sulfonamide compound and/or a hydroxy compound, and microcapsules containing a leuco dye and a photooxidizing agent. Alternatively, the light image forming material can be prepared by forming a self-supporting layer of the agoresaid dispersion.

A binder may be added to the aforesaid dispersion. Typical examples of binders include polyvinyl alcohol, methyl cellulose, carboxymethyl cellulose, hydroxypropyl cellulose, gum aarabic, gelatin, polyvinyl pyrrolidone, casein, styrene-butadiene latex, acrylonitrile butadiene latex, polyvinyl acetate, polyacrylic esters, ethylenevinyl acetate copolymer and other emulsions. The binder is used in an amount of 0.5 to 5 g/m$^2$ on a solids basis.

The coating amount of the light image forming material of the present invention is in the range of preferably 3 to 30 g/m$^2$, particularly preferably 5 to 20 g/m$^2$ on a solids basis. When the coating amount is less than 3 g/m$^2$, sufficient density is not obtained, while when the coating amount is more than 30 g/m$^2$, no additional improvement in quality is obtained and the use of such a large amount of the material is a cost disadvantage.

Materials suitable for us as supports in the present invention include papers such as tissue paper or thick cardboard; films of synthetic resins and polymers such as regenerated cellulose, cellulose acetate, cellulose nitrate, polyethylene terephthalate, vinyl polymers and copolymers, polyethylene, polyvinyl acetate, polymethyl methacrylate and polyvinyl chloride; and materials such as cloth, glass, wood and metals which are used in the field of graphic arts or decoration.

The aforesaid dispersion can be coated on a support by any conventional coating methods such as dip coating, air knife coating, curtain coating, roller coating, doctor coating, wire bar coating, slide coating, gravure coating, spin coating, and extrusion coating method using hopper described in U.S. Pat. No. 2,681,294.

Any convenient light source can be used for activation of the photo-oxidizing agent and for formation of an image by the leuco dye. The irradiation may be carried out by natural or artificial, monochromatic or incoherent or coherent light. The irradiation must be light image forming composition.

Examples of suitable light sources include fluorescent lamps, mercury lamps, various metal-addition lamps and arc lamps. Examples of coherent light sources include a nitrogen laser, a xenon laser, an argon ion laser and an ionized neon laser in which light emission is within the range of the absorption bands of visible light or UV of the photo-oxidizing agent, or is pulsed so as to give superposed zones. UV and near visible light irradiation-light emitting cathode ray tubes widely used in printing-out systems to write on the light sensitive materials are also useful for irradiating the light image forming material of the present invention.

An image may be formed by writing with beams of actitinic light, or by exposure with light traversing selected areas of a negative, stencil or other relatively opaque pattern. The negative may be silver on a film of cellulose acetate or a polyester, or may be one which is opaque due to the agglomeration of areas having different refractive indexes. The formation of the image may be made by conventional diazo printing devices, graphic art exposure, electronic flash devices or projection as described in U.S. Pat. No. 3,661,461. The exposure time varies depending on the density of light, the spectral energy distribution of light, the distance of light from the light image forming material, the properties and amount of the light image forming composition to be used and the color density of a desired image, but is in the range of from several fractions of a second to several minutes.

After exposure of the image, the image can be fixed by bringing the photo-oxidizing agent and the reducing agent into contact with each other by heating.

The light image forming material of the present invention can be used as a light image forming material excellent in manufacturability, image-forming property and storage stability.

The present invention is now illustrated in greater detail by reference to the following examples, but the present invention is not to be construed as limited to such in any way. In the following examples, unless otherwise indicated, all parts are by weight.

EXAMPLE 1

The following optical image forming material was prepared.

| Sample (1): | |
|---|---|
| Leuco dye: Leuco Crystal Violet | 3.0 parts |
| Photo-oxidizing agent: 2,2'-Bis-(o-chloro-phenyl)-4,4',5,5'-tetra-phenylbiimidazole | 3.0 parts |
| Tribromomethylphenylsulfone | 0.6 parts |
| 2,5-Di-tertiary-octylhydroquinone | 0.4 parts |
| Methylene chloride | 22 parts |
| Tricresyl phosphate | 24 parts |
| Takenate D-110N (trade name of 75% by weight ethyl acetate solution, manufactured by Takeda Chemical Industries, Ltd.) | 24 parts |

The above ingredients were mixed and then added to an aqueous solution composed of 63 parts of an aqueous solution of 8% by weight polyvinyl alcohol and 100 parts of distilled water. Then, the mixture was dispersed by emulsification at 20° C. to obtain an emulsion having an average particle diameter of 1 μm. The resulting emulsion was continuously stirred at 40° C. for 3 hours. The emulsion was then cooled to room temperature and filtered to obtain an aqueous capsule dispersion.

Next, the following components were mixed.

| | |
|---|---|
| Aqueous solution of 4% by weight polyvinyl alcohol | 150 parts |
| Reducing agent: 1-phenylpyrazolidine-3-one (phenidone A) | 30 parts |
| p-Toluene sulfonamide | 30 parts |

The mixture was dispersed using a Dyno mill (trade name, manufactured by willy A. Bachofen A.G.) to obtain a reducing agent-containing dispersion having an average particle diameter of 3 μm.

9 parts of the capsule dispersion was mixed with 6 parts of the aforesaid reducing agent containing dispersion. Super-calendared wood free paper (with a basis weight of 64 g/m$^2$) was coated with the resulting dispersion mixture in an amount so as to give a coating weight of 10 g/m$^2$ on a solid basis. The coated paper was dried by heating at 50° C. for one minute to obtain Sample (1).

COMPARATIVE EXAMPLE 1

The procedure of Example 1 was repeated except that p-toluenesulfonamide was not used to obtain Comparative Sample (1).

Sample (1) and Comparative Sample (1) were irradiated through an original having a line image with light using a jet light (ultra-high pressure mercury lamp, manufactured by Oak K.K.) to form a negative image.

After formation of images, a fixing operation was carried out by passing Sample (1) and Comparative Sample (1) at a velocity of 450 mm/min through heated rollers at 90° C. and at 120° C. Thereafter, these samples were subjected to overall surface light irradiation with a jet light for a period of five times with a same intensity that used for exposure of the image. Background density (fog) was measured by using a Macbeth reflection densitometer. The results obtained are shown in Table 1.

TABLE 1

| | Fixing Temperature (°C.) | Background Density after Overall Surface Light Irradiation |
|---|---|---|
| Sample (1) | 90 | 0.069 |
| | 120 | 0.069 |
| Comparative Sample (1) | 90 | 0.571 |
| | 120 | 0.069 |

Separately, the fresh background density of each sample and the background density thereof after storage of each sample at 60° C. under dry conditions for 24 hours were measured by using Macbeth reflection densitometer to examine the storage stability of Sample 1 and Comparative Sample (1). The results obtained are shown in Table 2.

TABLE 2

| | Fresh Background Density | Background Density after Dry Storage |
|---|---|---|
| Sample (1) | 0.069 | 0.071 |
| Comparative Sample (1) | 0.069 | 0.072 |

It is apparent from the above results that when the organic sulfonamide is added, an excellent low-temperature fixing technique can be achieved without an adverse effect on the storage property.

EXAMPLES 2 AND 3

The procedure of Example 1 was repeated except that each of o-toluenesulfonamide and p-ethylbenzenesulfonamide was used in place of p-toluenesulfonamide to obtain each of Sample (2) and Sample (3).

These samples were evaluated in the same way as in Example 1. Similar results were obtained.

EXAMPLE 4

The procedure of Example 1 was repeated except that tris(2-methyl-4-diethylaminophenyl)methane was used as a leuco dye in place of Leuco Crystal Violet and 2,6-bis(trichloromethyl)-4-(p-methoxyphenyl)triazine was used in place of tribromomethylphenylsulfone as one of the photo-oxidizing agents to prepare Sample (4).

Sample (4) was evaluated in the same way as in Example 1 (Sample 1). Similar results were obtained.

EXAMPLE 5

The procedure of Example 1 was repeated except that 10 parts of p-benzyloxyphenol was used in place of 30 parts of p-toluenesulfonamide to obtain Sample (5).

Sample (5) and Comparative Sample (1) were irradiated through an original having a line image with light using a jet light (ultra-high pressure mercury lamp, manufactured by Oak K.K.) to form a negative image.

After formation of the images, a fixing operation was carried out by passing Sample (5) and Comparative Sample (1) at a velocity of 450 mm/min through heated rollers at 90° C. and at 120° C. Thereafter, these samples were subjected to overall surface light irradiation with a jet light for a period of five times with a same intensity that used for exposure of the image. Background density (fog) was measured by using a Macbeth reflection densitometer. The results obtained are shown in Table 3.

TABLE 3

| | Fixing Temperature (°C.) | Background Density After Overall Surface Light Irradiation |
|---|---|---|
| Sample (5) | 90 | 0.068 |
| | 120 | 0.068 |
| Comparative Sample (1) | 90 | 0.571 |
| | 120 | 0.069 |

Separately, the fresh background density of each sample and the background density thereof after storage of each sample at 60° C. under dry conditions for 24 hours were measured using a Macbeth reflection densitometer to examine the storage stability of Sample (5) and Comparative Sample (1). The results obtained are shown in Table 4.

TABLE 4

| | Fresh Background Density | Background Density after Dry Storage |
|---|---|---|
| Sample (5) | 0.068 | 0.071 |
| Comparative Sample (1) | 0.069 | 0.072 |

It is apparent from the above results that when the hydroxy compound used in the present invention is added, an excellent low-temperature fixing technique can be achieved without having an adverse effect on the storage stability.

EXAMPLES 6 AND 7

The procedure of Example 5 was repeated except that each of p-xylylenediol and 2-hydroxymethyl-p-cresol was used in place of p-benzyloxyphenol to prepare Sample (6) and Sample (7).

These samples were evaluated in the same way as in Sample 5. Similar results were obtained.

While the invention has been described in detail and with reference to specific embodiments thereof, it will be apparent to one skilled in the art that various changes and modifications can be made therein without departing from the spirit and scope thereof.

What is claimed is:

1. A light image forming material comprising:

a support;

(A) at least one member selected from the group consisting of oxidative-developable leuco dyes;

(B) at least one member selected from the group consisting of photo-oxidizing agents;

(C) at least one reducing agent; and (D) at least one organic sulfonamide compound and/or at least one member selected from the group consisting of hydroxy compounds represented by the following Formula (I) or (II),

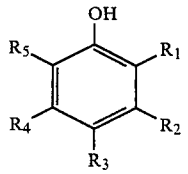

(I)

wherein $R_1$, $R_2$, $R_3$, $R_4$ and $R_5$, which may be the same or different, each represents a hydrogen atom, an alkyl group, a cycloalkyl group, an aryl group, an alkoxy group, a group of the formula $COOR_6$ or a group of the formula

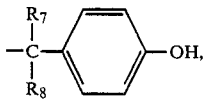

wherein each of said alkyl group, said aryl group and said alkoxy group may be substituted with at least one of a halogen atom, a hydroxyl group, an alkoxy group, an aryl group and an aryloxy group; $R_6$ represents an alkyl group and $R_7$ and $R_8$, which may be the same or different, each represents a hydrogen atom or an alkyl group,

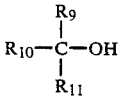

(II)

wherein $R_9$, $R_{10}$ and $R_{11}$, which may be the same or different, each represents a hydrogen atom, an alkyl group, an aryl group, a hydroxyalkyl group or an aryloxyalkyl group and each group may be substituted with at least one of a halogen atom, a hydroxyl group, an alkoxy group, an aryl group, an aryloxy group, a hydroxyalkyl group and a hydroxyalkoxy group, said leuco dye (A) and said photo-oxidizing agent (B) being present in microcapsules, and said reducing agent (C) and said organic sulfonamide compound and/or said hydroxy compound (D) being present outside said microcapsule.

2. The light image forming material of claim 1, wherein said microcapsules have walls of a member selected from the group consisting of polyurethanes, polyureas, polyesters, polycarbonates, urea-formaldehyde resins, melamine-formaldehyde resins, polystyrene, styrene-methacrylate copolymers, gelatin, polyvinyl pyrrolidone and polyvinyl alcohol or mixtures thereof.

3. The light image forming material of claim 2, wherein said high molecular weight material is selected from the group consisting of polyurethanes, polyureas, polyamides, polyesters, polycarbonates, polyurethanes and polyureas.

4. The light image forming material of claim 1, wherein the particle size of said microcapsules ranges from 0.1μ to 20μ.

5. The light image forming material of claim 1, wherein said leuco dyes are reduction type dyes which have one or two hydrogen atoms and are capable of developing color by the elimination of a hydrogen atom or by the addition of an additional electron forming a dye.

6. The light image forming material of claim 1, wherein said leuco dyes are selected from the group consisting of aminotriarylmethanes, aminoxanthenes, aminothioxanthenes, amino-9,10-dihydroacridines, aminophenoxazines, aminophenothiazines, aminodihydrophenazines, leuco indamine, aminohydrocinnamic acid, hydrazines, leuco indigoids, amino-2,3-dihydroanthraquinones, tetrahalo-p,p'-bisphenols, 2-(p-hydroxyphenyl)-4,5-diphenylimidazoles and phenethylanilines.

7. The light image forming material of claim 6, wherein said leuco dye is an aminotriarylmethane or the acid addition salts thereof.

8. The light image forming material of claim 7, wherein said aminotriarylmethanes or acid addition salts thereof are those wherein at least two of the aryl groups are phenyl groups having:

(a) A $R_1R_2N$-substituent group bonded to the benzene ring at a para-position with respect to the carbon atom of the methane moiety wherein $R_1$ and $R_2$ are each a member selected from the group consisting of a hydrogen atom, an alkyl group having from 1 to 10 carbon atoms, a 2-hydroxyethyl group, a 2-cyanoethyl group and a benzyl group, and (b) a substituent group bonded to the benzene ring at the ortho-position to the carbon atom of the methane moiety, this substituent group (b) being a member selected from the group consisting of a lower alkyl group having from 1 to 4 carbon atoms, a lower alkoxy group having from 1 to 4 carbon atoms, fluorine, chlorine, hydrogen and bromine;

or are those wherein the third aryl group may be the same as or different from the first two aryl groups and when the third aryl group is different from the first two aryl groups, the third aryl group is selected from the group consisting of:

(a) a phenyl group which may be optionally substituted with a lower alkyl group, a lower alkoxy group, chlorine, a diphenylamino group, a cyano group, a nitro group, a hydroxy group, fluorine, bromine, an alkylthio group, an arylthio group, a thio ester group, an alkylsulfone group, an arylsulfone group, a sulfo group, a sulfonamido group, an alkylamido group, an arylamide group, (b) a naphthyl group which may be substituted with an amino group, a di-lower alkylamino group or an alkylamino group, (c) a pyridyl group which may be substituted with an alkyl group, (d) a quionolyl group, and (e) an indolinylidene group which may be substituted with an alkyl group.

9. The light image forming material of claim 1, wherein said photo-oxidizing agent is selected from the group consisting of halogenated hydrocarbons, azide polymers, azide compounds, 3'-ethyl-1-methoxy-2-pyridothiacyanine perchlorate, 1-methoxy-2-methylpyridinium p-toluenesulfonate, a lophine dimer compounds, benzophenone, p-aminophenyl ketones, a polynuclear quinones and a thioxanthenone.

10. The light image forming material of claim 1, wherein the leuco dye and the photo-oxidizing agent are present in a molar ratio of from about 10:1 to about 1:10.

11. The light image forming material of claim 1, wherein the reducing agent is a free radical-capturing agent which traps free radicals of the photo-oxidizing agent after activation thereof.

12. The light image forming material of claim 1, wherein the reducing agent is selected from the group consisting of organic reducing agents having a hydroxyl group on a benzene ring and further a hydroxyl group or an amino group at another position than that position of the benzene ring and cyclic phenylhydrazide compounds.

13. The light image forming material of claim 1, wherein the reducing agent is present in an amount of 1 to 100 times on a mol basis to that of the photo-oxidizing agent.

14. The light image forming material of claim 1, wherein the organic sulfonamide compounds is selected from the group consisting of p-toluene sulfonamide, o-toluenesulfonamide, benzenesulfonamide, p-toluenesulfonanilide, N-(p-methoxyphenyl)-p-toluenesulfonamide, N-(o-methoxyphenyl)-p-toluenesulfonamide, N-(p-chlorophenyl)-p-toluenesulfonamide, N-(o-chlorophenyl)-p-toluenesulfontoluenesulfonamide, N-(p-tolyl)-p-toluenesulfonamide, N-(o-tolyl)-p-toluenesulfonamide, N-(o-hydroxyphenyl)-p-toluenesulfonamide, N-benzyl-p-toluenesulfonamide, N-(2-phenethyl)-p-toluenesulfonamide, N-(2-hydroxyethyl)-p-toluenesulfonamide, N-3-(3-methoxypropyl)-p-toluenesulfonamide, methanesulfonanilide, N-(p-tolyl)sulfonamide, N-(p-methoxyphenyl)sulfonamide, N-(o-methoxy)sulfonamide, N-(p-chlorophenyl)-sulfonamide, N-(o-chlorophenyl)sulfonamide, N-(2,4-xylyl)sulfonamide, N-(p-ethoxyphenyl)sulfonamide, N-benzylmethanesulfonamide, N-(2-phenoxyethyl)methanesulfonamide, 1,3-bis(methanesulfonylamino)benzene, 1,3-bis(p-toluenesulfonylamino)propane and p-ethylbenzenesulfonamide.

15. The light image forming material of claim 1, wherein the organic sulfonamide compound, when present, is present in an amount of 0.01 to 10 parts by weight, per part by weight of the reducing agent.

16. The light image forming material of claim 1, wherein the hydroxy compound is selected from the group consisting of p-t-butylphenol, p-t-octylphenol, p-α-cumylphenol, p-t-pentylphenol, m-xylenol, 2,5-dimethylphenol, 2,4,5-trimethylphenol, 3-methyl-4-isopropylphenol, p-benzylphenol, o-cyclohexylphenol, p-(diphenylmethyl)phenol, p-(α,α-diphenylethyl)-phenol, o-phenylphenol, ethyl p-hydroxybenzoate, propyl p-hydroxybenzoate, butyl p-hydroxybenzoate, benzyl p-hydroxybenzoate, p-methoxyphenol, p-butoxyphenol, p-heptyloxyphenol, p-benzyloxyphenol, dimethyl 3-hydroxyphthalates, 1,1-bis(4-hydroxyphenyl)-dodecane, 1,1-bis(4-hydroxyphenyl)-2-ethyl-hexane, 1,1-bis(4-hydroxyphenyl)-2-methyl-pentane, 2,2-bis(4-hydroxyphenyl)heptane, 2-t-butyl-4-methoxyphenol, 2,6-dimethoxyphenol, resorcinol mono-(2-hydroxyethyl)ether, 2-hydroxymethyl-p-cresol, 2,5-dimethyl-2,5-hexanediol, resorcinol bis(2-hydroxyethyl)ether, 1,4-bis(hydroxyethoxy)benzene, p-xylylenediol, 1-phenyl-1,2-ethanediol, diphenylmethanol, 1-diphenylethanol, 2-methyl-2-phenyl-1,3-propanediol, salicyl alcohol and 3-(o-methoxyphenoxy)-1,2-propanediol.

17. The light image forming material of claim 1, wherein the hydroxy compound, when present, is present in an amount of 0.01 to 10 parts by weight, per part by weight of the reducing agent.

18. An image recording method which comprises imagewise exposing the light image forming material as claimed in claim 1, to form an image and then causing a photo-oxidizing agent and a reducing agent to come into contact with each other.

* * * * *